US008375687B2

(12) United States Patent
Laurita

(10) Patent No.: US 8,375,687 B2
(45) Date of Patent: Feb. 19, 2013

(54) METHOD AND APPARATUS FOR CARRIER

(76) Inventor: Joseph N. Laurita, Wayne, NJ (US)

( * ) Notice: Subject to any disclaimer, the term of this patent is extended or adjusted under 35 U.S.C. 154(b) by 0 days.

(21) Appl. No.: 13/431,865

(22) Filed: Mar. 27, 2012

(65) Prior Publication Data

US 2012/0247068 A1 Oct. 4, 2012

(51) Int. Cl.
*B65D 6/26* (2006.01)

(52) U.S. Cl. ..... 53/458; 53/475; 53/543; 53/564

(58) Field of Classification Search ..... 53/458, 53/475, 543, 564
See application file for complete search history.

(56) References Cited

U.S. PATENT DOCUMENTS

| | | | | | |
|---|---|---|---|---|---|
| 2,517,178 | A | * | 8/1950 | Cheatham, Jr. | 217/15 |
| 2,841,306 | A | * | 7/1958 | Vitoux | 220/7 |
| 3,371,816 | A | * | 3/1968 | Ricci | 220/4.28 |
| 3,469,762 | A | * | 9/1969 | La Torre | 229/122 |
| 3,476,303 | A | * | 11/1969 | Smith | 229/117.08 |
| 3,497,127 | A | * | 2/1970 | Box | 220/7 |
| 3,735,430 | A | * | 5/1973 | Platz | 5/118 |
| 3,889,837 | A | * | 6/1975 | Wilson | 220/7 |
| 3,938,819 | A | * | 2/1976 | Martin | 280/19 |
| 4,057,165 | A | * | 11/1977 | Kardell | 220/6 |
| 4,171,058 | A | * | 10/1979 | Collins | 217/12 R |
| 4,181,356 | A | * | 1/1980 | Fleischer | 297/350 |
| 4,256,236 | A | * | 3/1981 | Haase | 220/6 |
| 4,609,116 | A | * | 9/1986 | Simms | 217/12 R |
| 4,781,300 | A | * | 11/1988 | Long | 220/7 |
| 4,955,925 | A | * | 9/1990 | Platti | 15/257.6 |
| 5,211,434 | A | * | 5/1993 | Lanava | 220/7 |
| 5,588,549 | A | * | 12/1996 | Furtner | 220/7 |
| 5,597,084 | A | * | 1/1997 | Parasin | 220/4.28 |
| 5,743,389 | A | * | 4/1998 | Cutler et al. | 206/216 |
| 6,233,766 | B1 | * | 5/2001 | Ohman | 5/627 |
| 6,640,944 | B2 | * | 11/2003 | Adams | 190/110 |
| 7,909,000 | B1 | * | 3/2011 | O'Neill et al. | 119/61.1 |
| 2005/0173269 | A1 | * | 8/2005 | Lebras | 206/170 |
| 2005/0189388 | A1 | * | 9/2005 | Godshaw et al. | 224/607 |
| 2006/0201849 | A1 | * | 9/2006 | Huang | 206/736 |
| 2010/0230479 | A1 | * | 9/2010 | Graham et al. | 229/108.1 |
| 2012/0061277 | A1 | * | 3/2012 | Lohse | 206/504 |

* cited by examiner

*Primary Examiner* — Hemant M Desai
(74) *Attorney, Agent, or Firm* — Walter J. Tencza, Jr.

(57) ABSTRACT

An apparatus is provided for transporting a plurality of beverage containers. The apparatus may include first, second, third, and fourth sides, and a floor. The first, second, third, and fourth sides may be attached to the floor so that the first second, third and fourth sides can pivot with respect to the floor, and so that each can be placed in a first state in which each is parallel with respect to the floor and in a second state in which each is at a ninety degree angle with respect to the floor. At least one of the first, second, third, and fourth sides may have a bottom protrusion which can be adhered to the floor in the second state, to hold at least one of the first, second, third, and fourth sides in the second state.

13 Claims, 11 Drawing Sheets

METHOD AND APPARATUS FOR CARRIER

FIELD OF THE INVENTION

This invention relates to improved methods and apparatus concerning carriers.

BACKGROUND OF THE INVENTION

Milk carriers or cases, such as case or carrier 100 shown in FIG. 1A, in their present form present many problems in the dairy industry as well as the beverage industries. The milk carriers or cases are typically molded or made as a box—four side sides and a bottom, as shown in FIG. 1A,—and this restricts handling and storage as well as transportation.

The molds and tooling that are needed to manufacture these known cases or carriers are complicated, expensive and require costly machinery necessary to produce these cases or carriers at low production cycles. Distortion and dimensional problems restrict the machine cycles as well as plastics or materials being used. Beverage and dairy industries are reluctant to change because their processing lines are complicated and changing would incur tremendous costs.

SUMMARY OF THE INVENTION

In at least one embodiment an apparatus or carrier is provided for transporting a plurality of beverage containers. The apparatus may include first, second, third, and fourth sides; and a floor. The first, second, third, and fourth sides may be attached to the floor so that the first second, third and fourth sides can pivot with respect to the floor, and so that each of the first, second, third, and fourth sides can be placed in a first state in which each of the first, second, third, and fourth sides are substantially parallel with respect to the floor and in a second state in which each of the first, second, third, and fourth sides are substantially at a ninety degree angle with respect to the floor. In at least one embodiment, at least one of the first, second, third, and fourth sides has a bottom protrusion which can be adhered to the floor in the second state, to hold at least one of the first, second, third, and fourth sides in the second state. In at least one embodiment, each of the first, second, third, and fourth sides has a bottom protrusion which can be adhered to the floor in the second state, to hold the first, second, third, and fourth sides, respectively, in the second state.

In at least one embodiment, at least one of the first, second, third, and fourth sides has a first protrusion which can be adhered to one of the other sides of the first, second, third, and fourth sides to hold at least one of the first, the second, the third, and the fourth sides in the second state. In at least one embodiment, each of the first, second, third, and fourth sides has a first protrusion which can be adhered to one of the other sides of the first, second, third, and fourth sides to hold the first, the second, the third, and the fourth sides, respectively, to one of the other sides of the first, second, third, and fourth sides in the second state.

In at least one embodiment, the at least one of the first, second, third, and fourth sides which has a first protrusion also has a second protrusion which is opposite the first protrusion, and which can be adhered to one of the other sides of the first, second, third, and fourth sides to hold at least one of the first, the second, the third, and the fourth sides in the second state. In at least one embodiment, each of the first, second, third, and fourth sides has a second protrusion, which is opposite the first protrusion and which can be adhered to one of the other sides of the first, second, third, and fourth sides to hold the first, the second, the third, and the fourth sides, respectively, to one of the other sides of the first, second, third, and fourth sides in the second state.

In at least one embodiment, a method is provided which includes the steps of forming a plurality of carriers, placing each of the plurality of carriers in a first state, stacking the plurality of carriers on top of one another in a transportation vehicle, while each of the plurality of carriers is in the first state. Each of the plurality of carriers may be an apparatus for transporting a plurality of beverage carriers configured as previously described.

The method may further include, after stacking the plurality of carriers on top of one another in the transportation vehicle, transporting the plurality of containers from one geographic location to another geographic location. The method may also include thereafter forming each of the plurality of carriers into the second state, and thereafter placing a plurality of beverage containers into each of the plurality of carriers.

DETAILED DESCRIPTION OF THE DRAWINGS

Figure 1A:
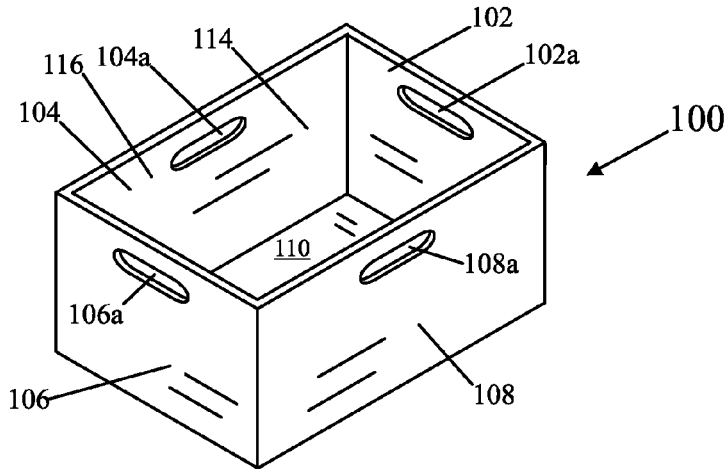
Fig. 1A (Prior Art)
FIG. 1A shows a perspective view of a carrier of the prior art.
Figure 1B:
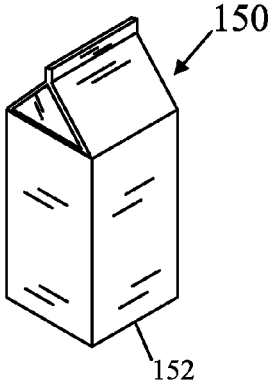
Fig. 1B (Prior Art)
FIG. 1B shows a perspective view of a typical known milk carton of the prior art.
Figure 1C:
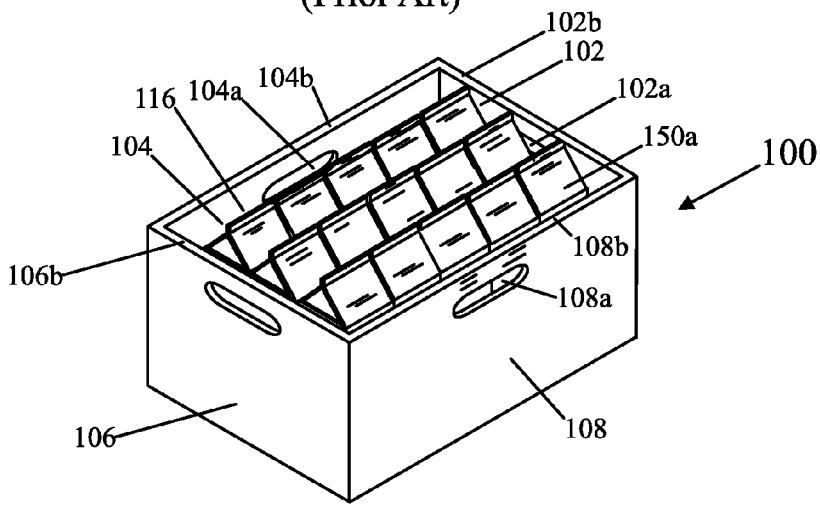
Fig. 1C (Prior Art)
FIG. 1C shows a perspective view of a plurality of typical known milk cartons inserted into the carrier of FIG. 1A.

FIG. 1A shows a perspective view of a carrier 100 of the prior art. FIG. 1B shows a perspective view of a typical known milk carton 150 of the prior art. FIG. 1C shows a perspective view of a plurality of typical known milk cartons 150*a*, 150*b*, 150*c*, and 150*d*, each of which may be identical to milk carton 150 and each of which may include milk inside, with the cartons 150*a-d* inserted into the carrier 100 of FIG. 1A. The carrier 100 may have sides 102, 104, 106, and 108 and bottom 110, each of which may be made of a hard, rigid material, such as a hard plastic, or wood. The side 102 is typically rigidly fixed to the sides 104 and 108, and to the bottom or floor 110, so that the side 102 cannot be changed in orientation with respect to the sides 104 and 108 and the floor 110, without breaking the carrier 100. The side 104 is typically rigidly fixed to the sides 102 and 106, and to the bottom or floor 110, so that the side 104 cannot be changed in orientation with respect to the sides 102 and 106 and the floor 110, without breaking the carrier 100. The side 106 is typically rigidly fixed to the sides 104 and 108, and to the bottom or floor 110, so that the side 106 cannot be changed in orientation with respect to the sides 104 and 108 and the floor 110, without breaking the carrier 100. The side 108 is typically rigidly fixed to the sides 102 and 106, and to the bottom or floor 110, so that the side 108 cannot be changed in orientation with respect to the sides 102 and 106 and the floor 110, without breaking the carrier 100.

Referring to FIGS. 1A and 1C, the sides 102, 104, 106, and 108, along with the bottom or floor 110 enclose and/or surround a chamber 116 through an opening 114 at the top of the carrier 100. The plurality of milk cartons 150*a* can be inserted through the opening 114 into the chamber 116 and rested on the floor 110. The carrier 100 can be lifted by the handles or openings 102*a*, 104*a*, 106*a*, and/or 108*a* Each of the milk cartons of the plurality of milk cartons 150*a* may be identical to milk carton 150 shown in FIG. 1B. Typically, all of the milk cartons 150*a* sit on the floor or surface 110, so that they are all below the tops 102*b*, 104*b*, 106*b*, and 108*b* of the carrier 100. Thus another carrier, identical to 100 can be placed on top of the carrier 100 without contacting the milk cartons 150*a* Typically the milk cartons 150*a* utilize the substantially the entire chamber 116, so that the milk cartons 150*a* snugly fit into the chamber 116.

Figure 2A:
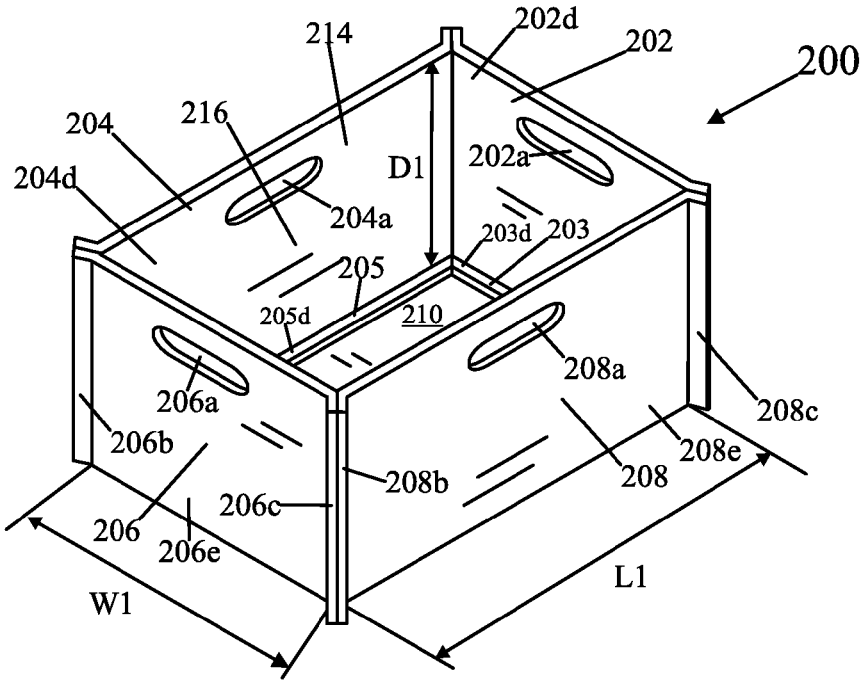
FIG. 2A shows a top, front, right side perspective view of a foldable carrier in accordance with an embodiment of the present invention with the foldable carrier shown in an upright and assembled state.
Figure 2B:
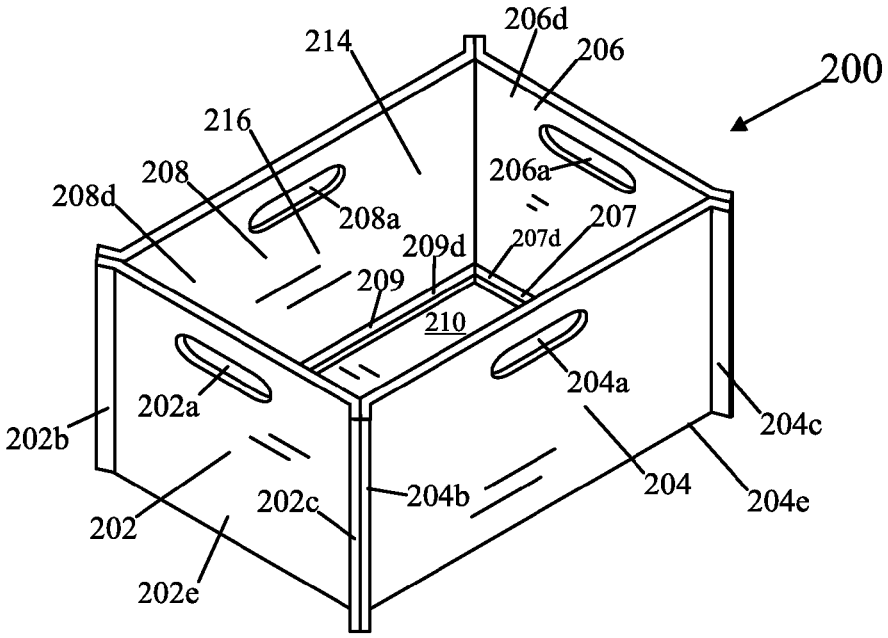
FIG. 2B shows a top, rear, left side perspective view of the carrier of FIG. 2A in the upright and assembled state.
Figure 3A:
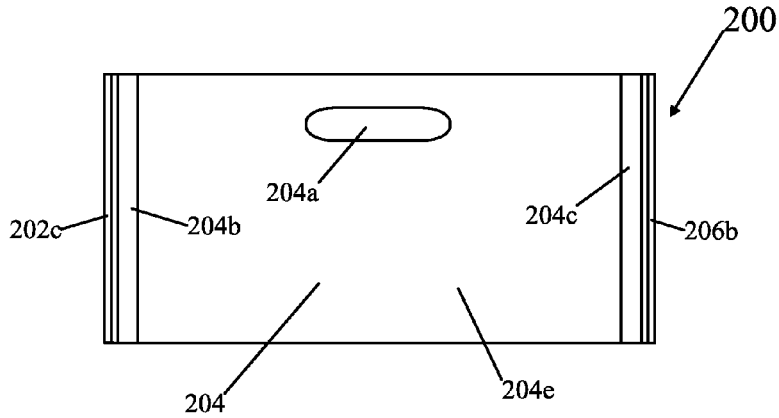
FIG. 3A shows a left side view of the carrier of FIG. 2A in the upright and assembled state.
Figure 3B:
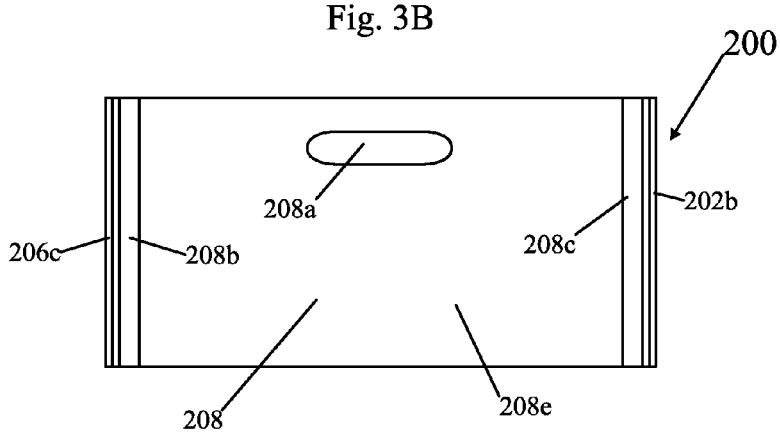
FIG. 3B shows a right side view of the carrier of FIG. 2A in the upright and assembled state.
Figure 3C:
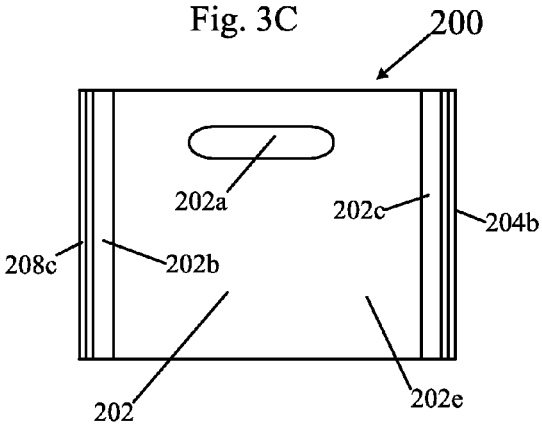
FIG. 3C shows a front view of the carrier of FIG. 2A in the upright and assembled state.
Figure 3D:
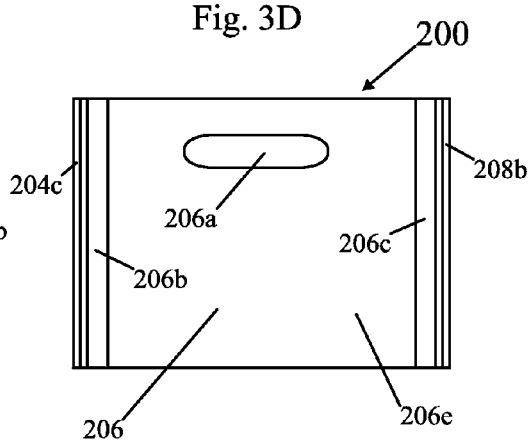
FIG. 3D shows a rear view of the carrier of FIG. 2A in the upright and assembled state.
Figure 4A:
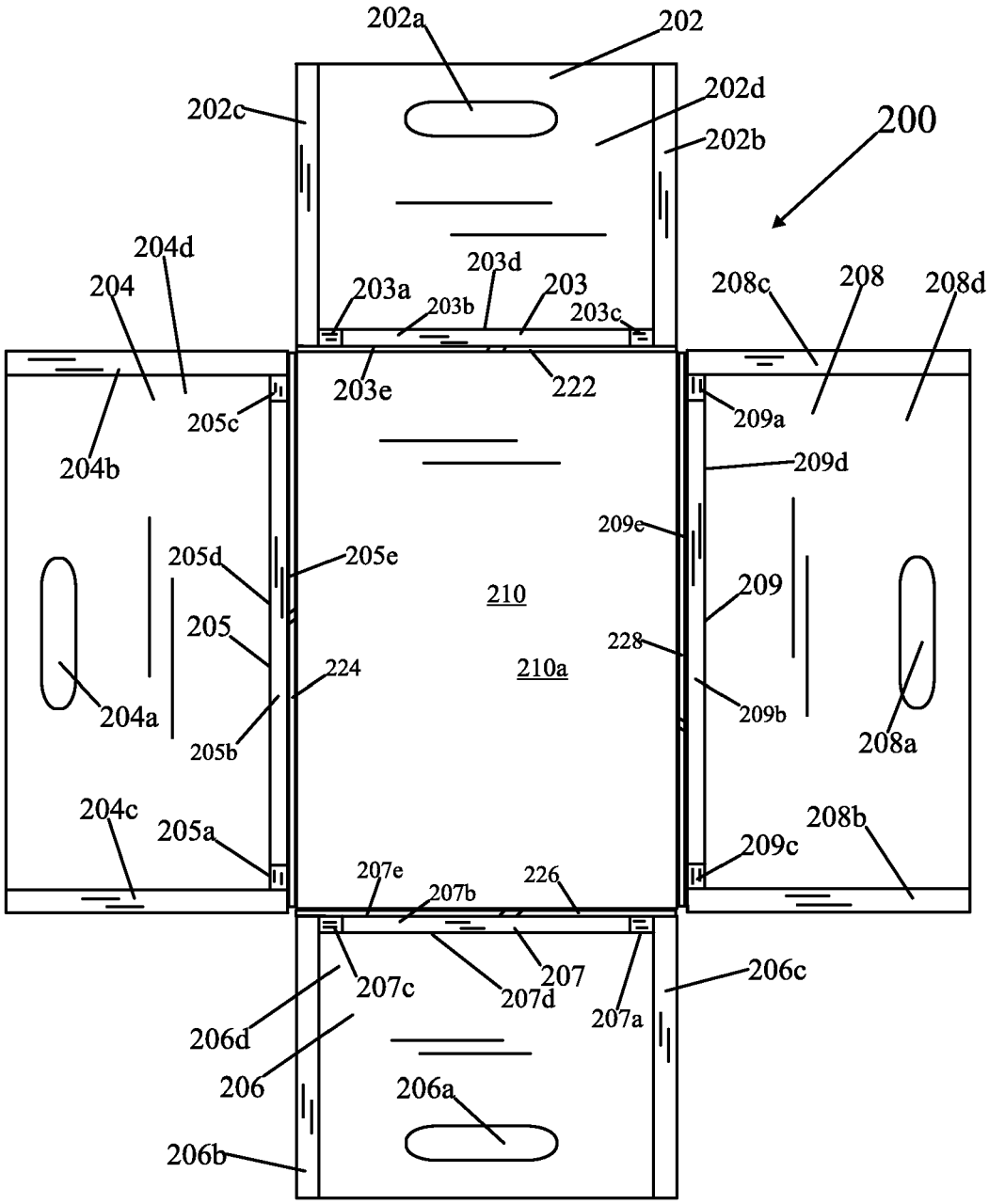
FIG. 4A shows a top view of the carrier of FIG. 2A in a collapsed state.
Figure 4B:
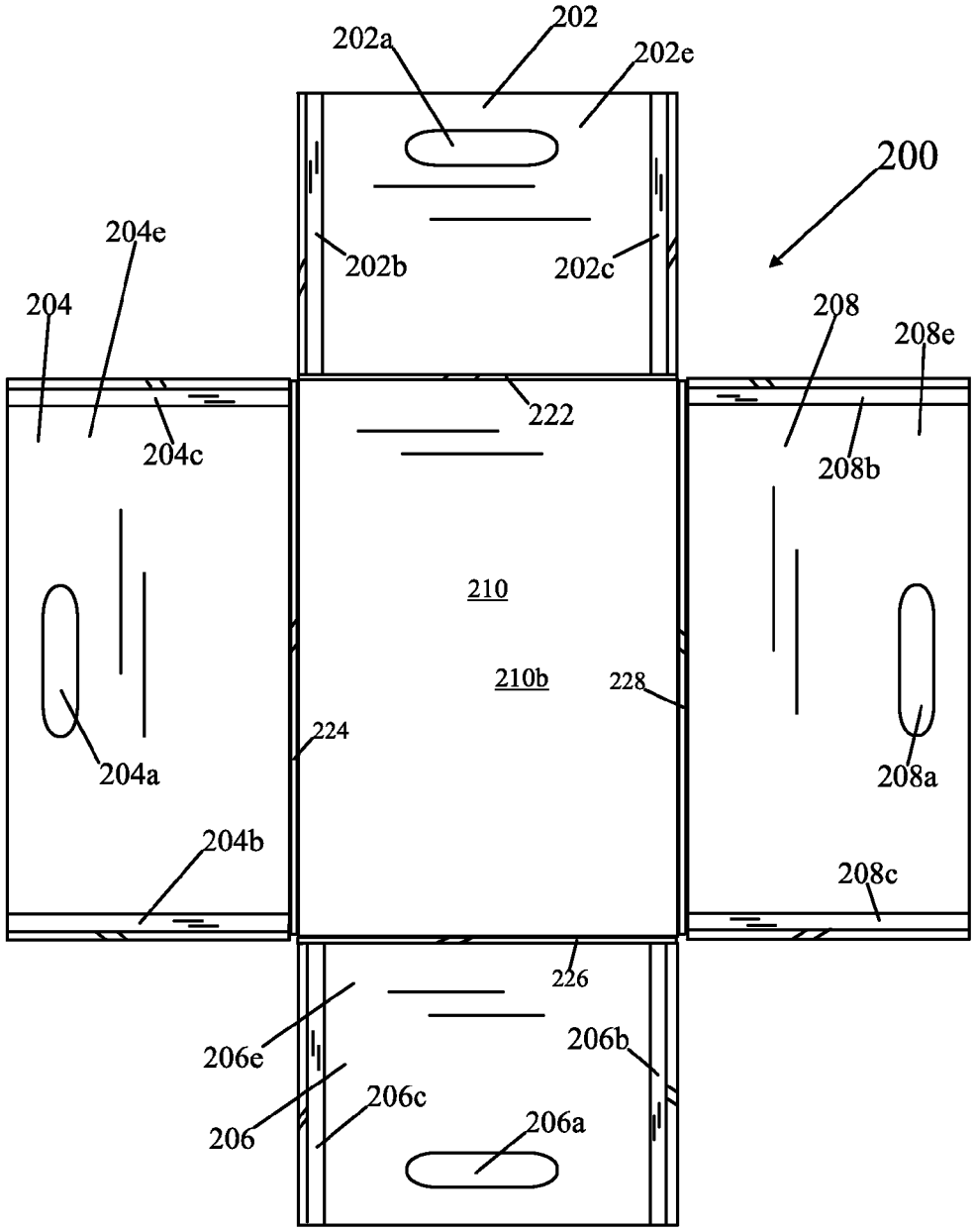
FIG. 4B shows a bottom view of the carrier of FIG. 2A in a collapsed state.
Figure 5A:
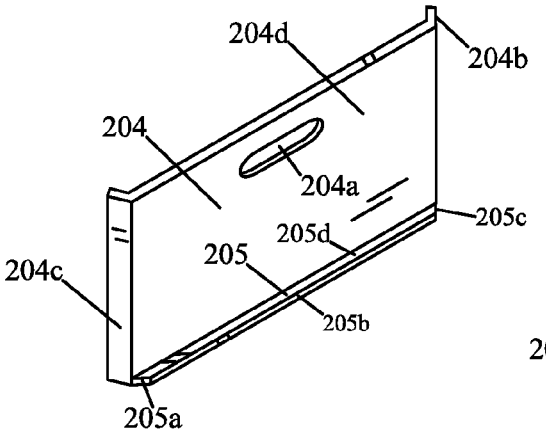
FIG. 5A shows a perspective view of the left side of the carrier of FIG. 2A.
Figure 5B:
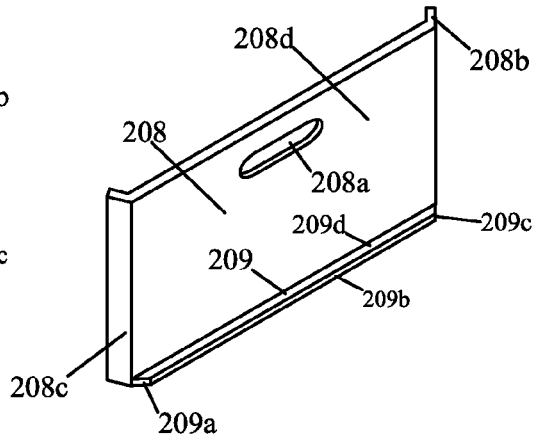
FIG. 5B shows a perspective view of the right side of the carrier of FIG. 2A.
Figure 5C:
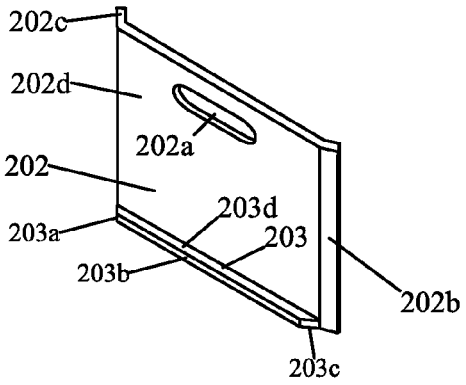
FIG. 5C shows a perspective view of the front of the carrier of FIG. 2A.
Figure 5D:
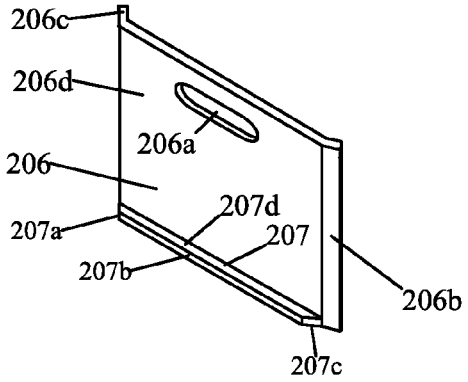
FIG. 5D shows a perspective view of the rear of the carrier of FIG. 2A.

FIG. 2A shows a top, front, right side perspective view of a foldable carrier 200 in accordance with an embodiment of the present invention with the foldable or collapsible carrier 200 shown in an upright and assembled state. FIG. 2B shows a top, rear, left side perspective view of the carrier 200 in the upright and assembled state. FIGS. 3A-D show a left side, right side, front, and rear views of the carrier 200 in the upright and assembled state. FIG. 4A shows a top view of the carrier 200 in a collapsed state. FIG. 4B shows a bottom view of the carrier 200 in a collapsed state. FIGS. 5A-D show left side, right side, front, and rear perspective views of the carrier 200 of FIG. 2A.

Referring to FIGS. 2A-5D, the carrier 200 includes sides 202, 204, 206, and 208, and bottom or floor 210. The sides 202, 204, 206, and 208 include openings or handles 202*a*, 204*a*, 206*a*, and 208*a*, respectively. Each of the sides 202, 204, 206, and 208 also include a flat panel having an inner surface and an outer surface. Side 202 has a flat panel having an inner surface 202*d* shown in FIG. 5C and an outer surface 202*e* shown in FIG. 3C. Side 204 has a flat panel having an inner surface 204*d* shown in FIG. 5A and an outer surface 204*e* shown in FIG. 3A. Side 206 has a flat panel having an inner surface 206*d* shown in FIG. 5D and an outer surface 206*e* shown in FIG. 3D. Side 208 has a flat panel having an inner surface 208*d* shown in FIG. 5B and an outer surface 208*e* shown in FIG. 3B.

Each of the sides 202, 204, 206, and 208 have left and right protrusion portions. Side 202 has a left protrusion portion 202*b* and a right protrusion portion 202*c* shown by FIGS. 5C, 4B, and 3C. Side 204 has a left protrusion portion 204*b* and a right protrusion portion 204*c* shown by FIGS. 5A, 4B, and 3A. Side 206 has a left protrusion portion 206*b* and a right protrusion portion 206*c* shown by FIGS. 5D, 4B, and 3D. Side 208 has a left protrusion portion 208*b* and a right protrusion portion 208*c* shown by FIGS. 5B, 4B, and 3B.

Each of the sides 202, 204, 206, and 208 have bottom protrusion portions. Side 202 has a bottom protrusion 203 shown in FIGS. 2A, 4A, 5C. The bottom protrusion 203 has a top surface 203*d*, slanted or tapered surfaces 203*a* and 203*c*, and straight surface 203*b* Side 204 has a bottom protrusion 205 shown in FIGS. 2A, 4A, 5A. The bottom protrusion 205 has a top surface 205*d*, slanted or tapered surfaces 205*a* and 205*c*, and straight surface 205*b* Side 206 has a bottom protrusion 207 shown in FIGS. 2B, 4A, 5D. The bottom protrusion 207 has a top surface 207*d*, slanted or tapered surfaces 207*a* and 207*c*, and straight surface 207*b* Side 208 has a bottom protrusion 209 shown in FIGS. 2B, 4A, 5B. The bottom protrusion 209 has a top surface 209*d*, slanted or tapered surfaces 209*a* and 209*c*, and straight surface 209*b*.

Each of the sides 202, 204, 206, and 208 may be made of a hard rigid material, such as a hard plastic, composition, fiber resin, or any material that can form the carrier as configured or as designed. The sides 202, 204, 206, and 208 may be attached to the bottom or floor 210 by hinges or flexible foldable members 222, 224, 226, and 228, respectively, as shown in FIG. 4A, or by any flexible means. The hinges or flexible foldable members 222, 224, 226, and 228 allow the carrier 200 to be placed in a collapsed or folded state such as shown by FIGS. 4A and 4B.

Figure 6:
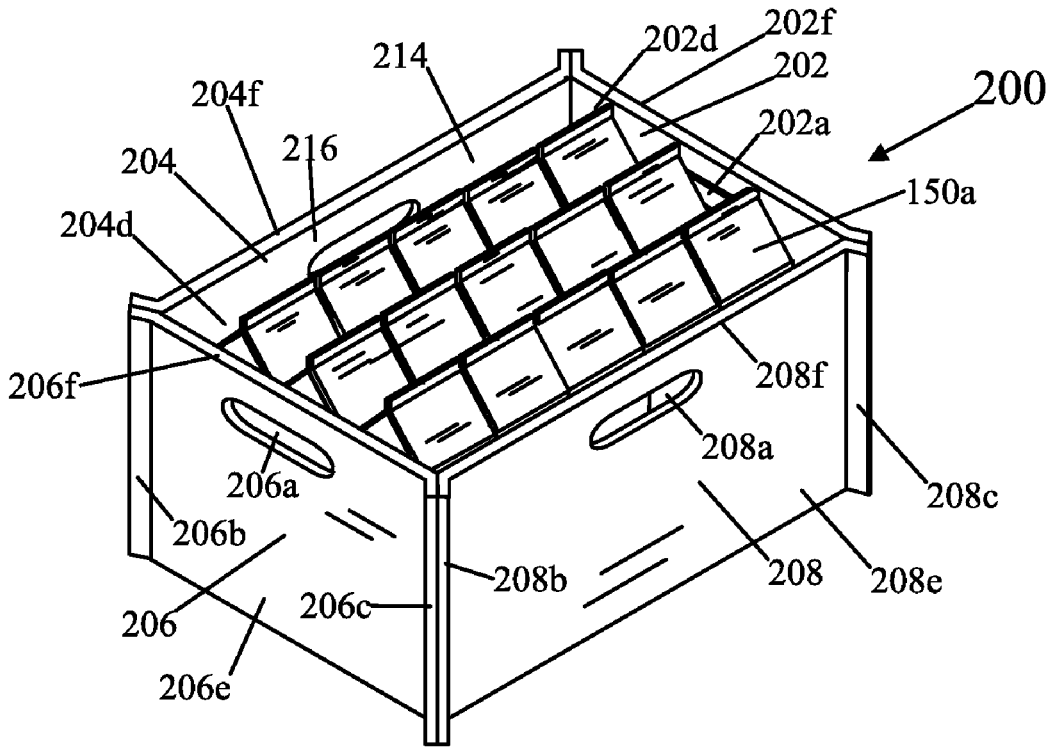
FIG. 6 shows a top, front, right side perspective view of the carrier of FIG. 2A in the upright and assembled state with a plurality of milk cartons inserted inside a chamber of the carrier of FIG. 2A.
Figure 7A:
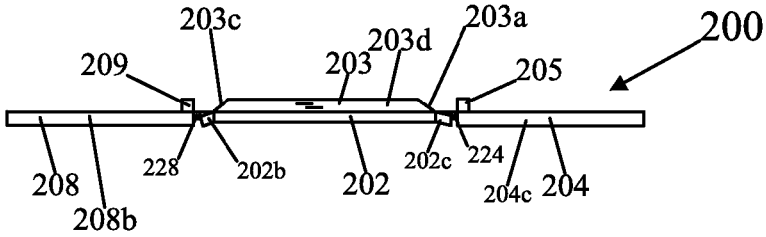
FIG. 7A shows a rear view of the carrier of FIG. 2A in a flattened or collapsed state.
Figure 7B:
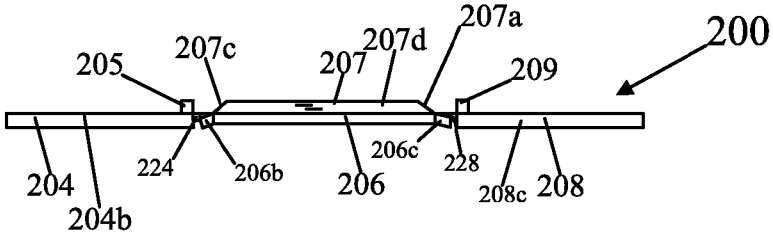
FIG. 7B shows a front view of the carrier of FIG. 2A in a flattened or collapsed state.
Figure 7C:
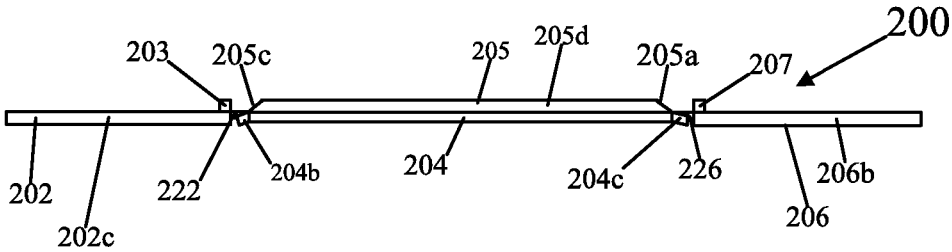
FIG. 7C shows a left side view of the carrier of FIG. 2A in a flattened or collapsed state.
Figure 7D:
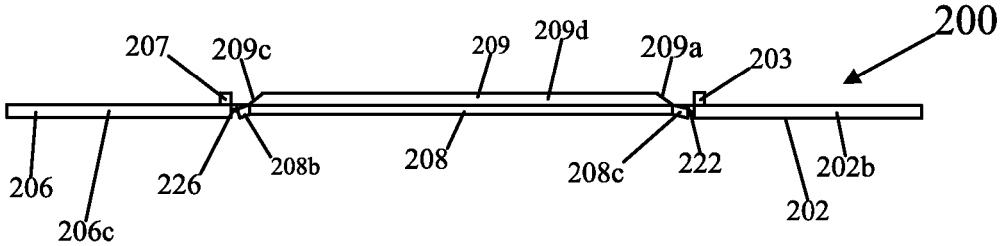
FIG. 7D shows a right side view of the carrier of FIG. 2A in a flattened or collapsed state.

FIG. 6 shows a top, front, right side perspective view of the carrier 200 in the upright and assembled state with the plurality of milk cartons 150*a* inserted through the opening 214 and inside the chamber 216 of the carrier 200, so that the milk cartons 150*a* sit on and are supported by the floor or bottom 210. Each of the milk cartons of the plurality of milk cartons 150*a* may be identical to milk carton 150 shown in FIG. 1B. The milk cartons 150*a* sit on the floor or surface 210, so that they are all below the tops 202*f*, 204*f*, 206*f*, and 208*f* shown in FIG. 6, of the assembled or upright carrier 200. Thus another carrier, identical to 200 can be placed on top of the carrier 200 without contacting the milk cartons 150*a* The milk cartons 150*a* utilize the substantially the entire chamber 216, so that the milk cartons 150*a* snugly fit into the chamber 216. Each of the milk cartons 150*a* may be quarts, half gallon, or gallon milk cartons. Alternatively, other types of milk containers, such as bottles, may be placed in carrier 200 and carrier 200 may be sized appropriately, so that a plurality of milk containers fits snugly within the walls of the carrier 200 without exceeding the tops 202*f*, 204*f*, 206*f*, and 208*f* while sitting on the floor or surface 210.

FIGS. 7A, 7B, 7C, and 7D show rear, front, left side, and right side views, respectively, of the carrier 200 in a flattened or collapsed state.

Figure 8A:
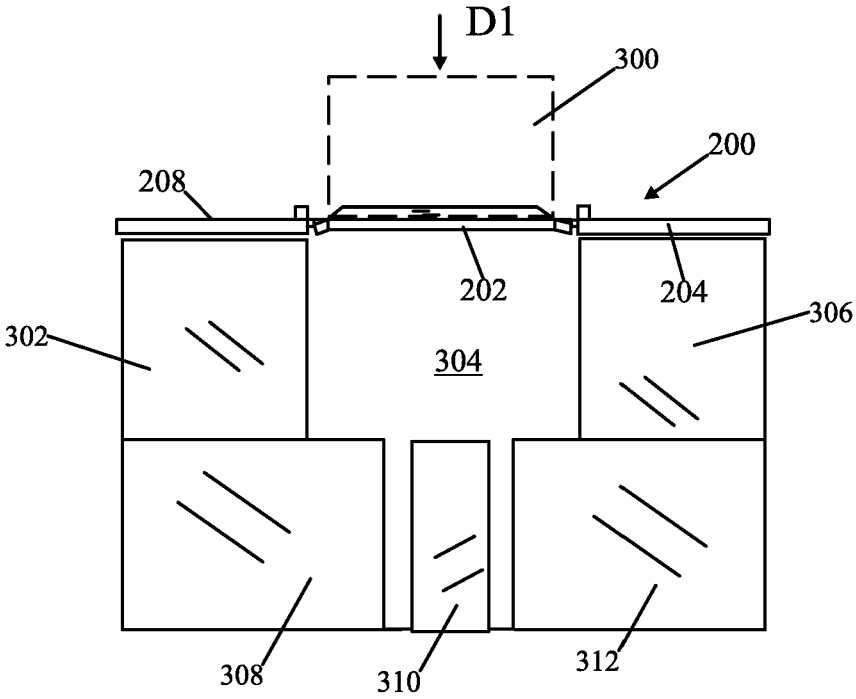
FIG. 8A shows a rear view of the carrier of FIG. 2A in a flattened state, along with components for changing the carrier from the flattened state to the upright and assembled state.
Figure 8B:
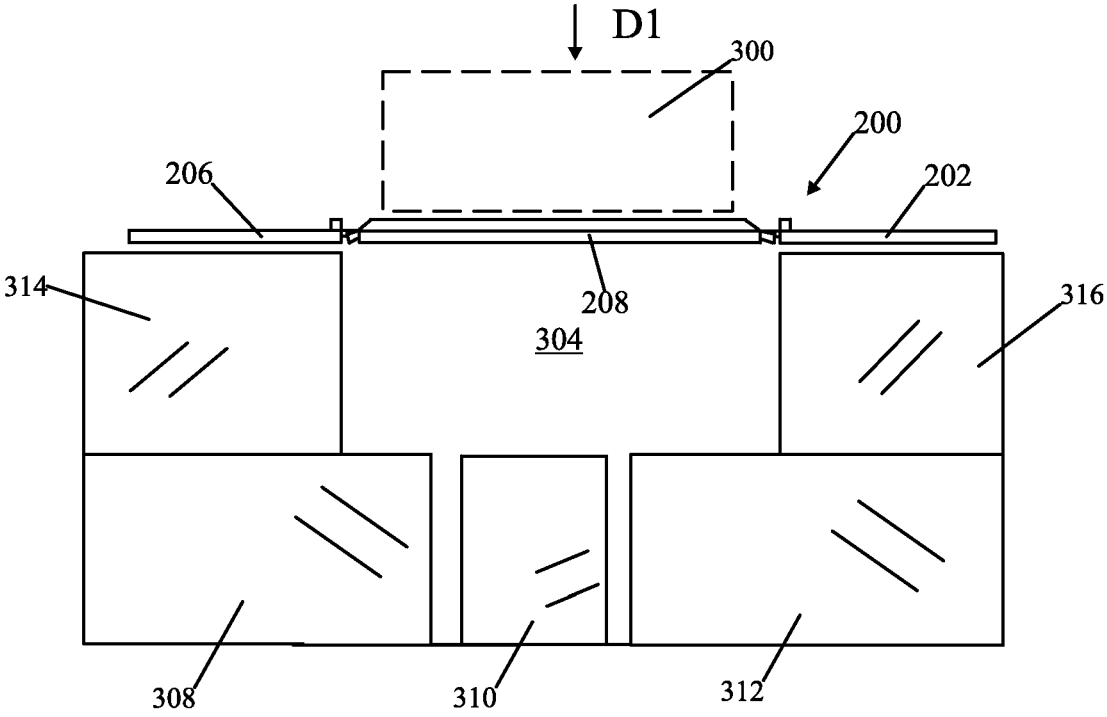
FIG. 8B shows a right side view of the carrier of FIG. 2A in a flattened state, along with components for changing the carrier from the flattened state to the upright and assembled state.

FIG. 8A shows a rear view of the carrier 200 in a flattened state, along with components for changing the carrier 200 from the flattened state to the upright and assembled state. FIG. 8B shows a right side view of the carrier 200 in a flattened state, along with components for changing the carrier 200 from the flattened state to the upright and assembled state. Components for changing the state of carrier 200 from flattened to upright and assembled may include a solid plunger or solid member 300, shown by dashed lines in FIGS. 8A and 8B, solid plungers or solid members 302 and 306 shown in FIG. 8A, and solid plungers or solid members 314 and 316 shown in FIG. 8B. Base members 308 and 312 may support the solid plungers 302, 306, 314, and 316, while allowing the plungers 302, 306, 314, and 316 to slide. A solid plunger or member 310 is also provided and shown in FIGS. 8A and 8B.

In operation, an adhesive may be placed on portions 202*b*, 202*c*, 204*b*, 204*c*, 206*b*, 206*c*, 208*b*, 208*c*, 203*a*, 203*c*, 205*a*, 205*c*, 207*a*, 207*c*, 209*a*, and 209*c* shown in FIG. 4A. Next the solid plunger 300 may push on the inside surface 210*a* shown in FIG. 4A, of the floor 210 of the carrier 200. The solid plunger 300 has an area which contacts the inside surface 210*a* of the floor 210 but which does not contact or overlap the sides 202, 204, 206, and 208 or the hinges 222, 224, 226, and 228. The solid plunger pushes on the inside surface 210*a* in the direction D1, shown in FIG. 8A. This causes the floor 210 to go down into a chamber or cavity 304 between members or plungers 302, 306, 314, and 316. This also causes the sides 202, 204, 206, and 208 to pivot about hinges 222, 224, 226, and 228, respectively. The plunger 300 pushes the floor 210 down into the chamber 304 until a exterior bottom surface 210*b* of the floor 210 shown in FIG. 4B comes in contact with the members 308 and 312. When the bottom surface 210*b* of the floor 210 has contacted the members 308 and 312, the sides 202, 204, 206, and 208 are upright and at a ninety degree angle with respect to the floor 210. In addition, the protrusions or portions 202*c* and 204*b*, 202*b* and 208*c*, 208*b* and 206*c*, 206*b* and 204*c*, as well as 204*b* and 202*c* are adhered together by adhesive, solvent, or mechanical means. Also, the portions 203*c* and 209*a*, 209*c* and 207*a*, 207*c* and 205*a*, as well as 205*c* and 203*a*, are adhered together by adhesive. In addition, the members 203, 205, 207, and 209 may be adhered to the inner surface 210*a* of the floor 210 by adhesives on the sides opposite sides 203*d*, 205*d*, 207*d*, and 209*d*.

Figure 8C:
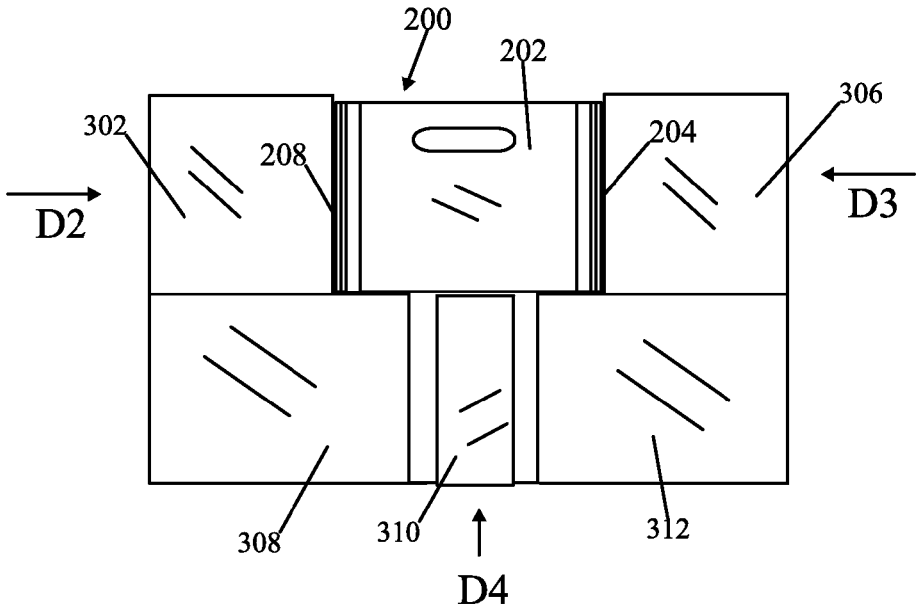
FIG. 8C shows a rear view of the carrier of FIG. 2A in an upright and assembled state, along with components for changing the carrier from the flattened state to the upright and assembled state.
Figure 8D:
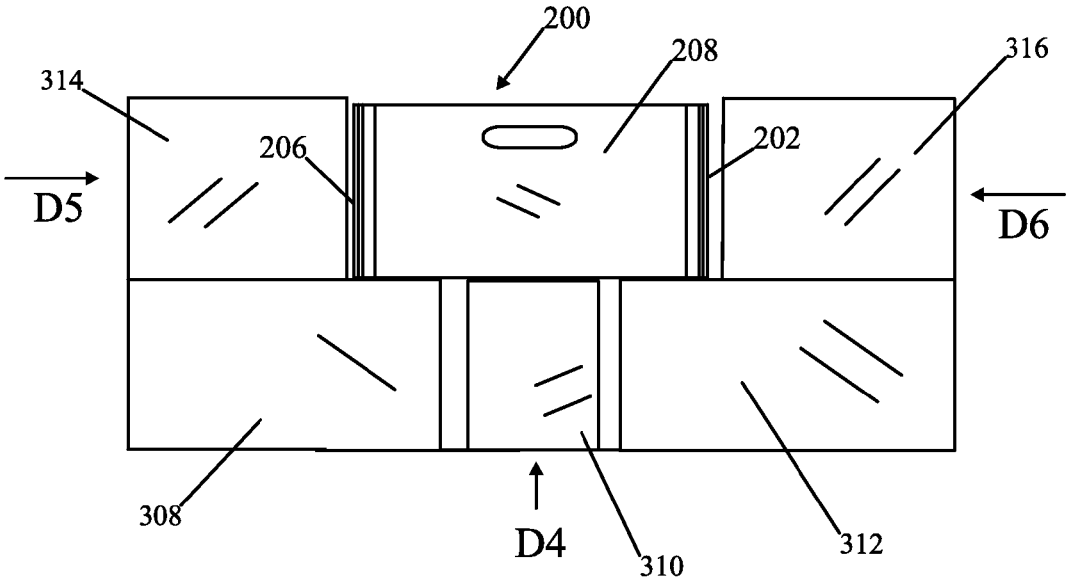
FIG. 8D shows a right side view of the carrier of FIG. 2A in an upright and assembled state, along with components for changing the carrier from the flattened state to the upright and assembled state.

The carrier 200 may be further pressed together into its assembled and upright state in the directions D2 and D3 shown in FIG. 8C and in the directions D5 and D6 shown in FIG. 8D, by the plungers or members 302, 306, 314, and 316, respectively. The plungers or members 302, 304, 314, and 316 may press on sides 208, 204, 206, and 202, respectively, to press the carrier 200 into a solid upright form.

After the carrier 200 has been pressed into the upright and assembled form, the plunger 310 may push the carrier 200 out of the chamber 304 to eject the carrier 200 in the upright and assembled form shown in FIGS. 2A and 2B.

In operation, the carrier 200 may be machine molded in the collapsed or flattened state of FIGS. 4A and 4B. The carrier 200 may entirely or substantially be made of one material, such as a plastic, composition, fiberglass or any material that can form the carrier 200 as configured or as designed.

The sides 202, 204, 206 and 208 may then be folded up with respect to the bottom 210 to place the sides at a ninety degree angle with respect to the bottom 210. In this state, the protrusions or flared portion 204*b* and 202*c*, 204*c* and 206*b*, 208*b* and 206*c*, and 208*c* and 202*b*, can be fixed to each other by an adhesive placed on either of their surfaces. For example, an adhesive may be placed on flared portion 204*b* which is then attached and fixed by the adhesive to portion 202*c*, to keep the sides 202 and 204 upright.

In addition, an adhesive may be used to attach and/or fix, portion 203*c* to portion 209*a*, portion 209*c* to portion 207*a*, portion 206*c* to portion 205*a*, and portion 205*c* to portion 203*a*, to further strengthen the carrier or case 200 in its upright and assembled state of FIGS. 2A and 2B.

One or more embodiments of the present invention do not require major changes or costs for milk packagers. The cost of producing, and tooling for the carrier or case 200 in accordance with an embodiment of the present invention is significantly less than that required to produce tooling for the carrier 100 of the prior art, for at least the reason that the carrier 200 is made in a flat state. One or more embodiments of the present invention, allow an operator to reduce machinery size needed to run tooling for carrier 200 versus tooling for old carrier 100. Tooling for case or carrier 200, allows for shrinkage adjustments—making it possible to run different materials giving purchasing advantages, whereas a mold for carrier 100 does not allow for shrinkage adjustments, this is because mold sizes for old carrier 100 are fixed and cannot be adjusted.

In addition, distortion problems will be minimized because when the carrier 200 is in a flat state as shown in FIGS. 7A-8B, stresses are reduced.

If a mold for carrier 200 is run off dairy on beverage premises, transportation costs will reduce dramatically. Now a fifty-three foot trailer can hold approximately three thousand four hundred cases or carriers, in a collapsed form such as shown in FIG. 4A, each of which is identical to 200 or substantially similar.

New case or carrier, such as carrier 200, will allow more carriers (identical to 200) to be shipped by a truck, train, or cargo carrying ship, because in the flat state shown in FIGS. 7A-8B, more carriers 200 can fit into a cargo container, then for an old carrier 100 which can not be placed in a flat state.

The carrier or case 200 can be made of a disposable and/or recyclable material, which can reduce costs and handling.

Costs for shipping, and/or transporting cases, identical to case or carrier 200 cross country, allows possible expanding market because trailers will hold more cases or carriers 200 in the flat state, then they can hold old carriers 100 in the non-flat state.

By using one or more embodiments of the present application, dairy or beverage industries or companies will have the following options. The dairy or company may buy a system and apparatus (entire package) for manufacturing cases or carriers, identical to case or carrier 200, and the system may be installed on premises of the dairy or beverage company. Thus no outside suppliers may be needed, in at least one embodiment.

Alternatively, the dairy or company, may have the carrier 200 molded in the flattened form of FIGS. 4A and 4B, off premises and then sides 202, 204, 206, and 208 can be folded upwards and then the protrusions 204*b* and 202*c*, 202*b* and 208*c*, 208*b* and 206*c*, 206*c* and 204*c*, can be sealed together by an adhesive to fix the carrier 200 in the upright and assembled state of FIGS. 2A and 2B. The assembling or changing of the carrier 200 from the flattened or collapsed state of FIGS. 4A and 4B to the assembled and upright state of FIGS. 2A and 2B can be done in house by a company on a production line, which can give a company total control and allow a company to assembled carriers 200 in the upright and assembled state as needed.

One or more embodiments of the present invention reduce case or carrier handling and storage costs significantly. Any of the exterior surfaces of the sides 202, 204, 206, and 208 can be used for advertising, and ads can be easily placed on the carrier 200 when it is in the flattened or collapsed state of FIGS. 4A and 4B. The weight of the carrier 200 may also be made less than the weight of carrier 100 of the prior art.

Figure 9A:
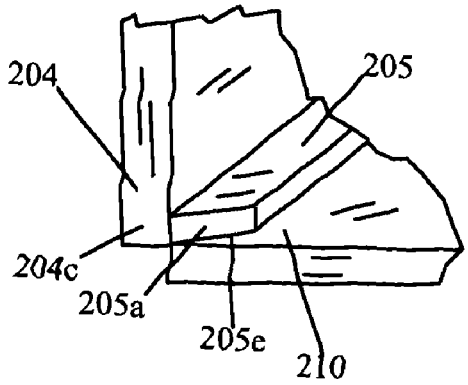
FIG. 9A shows a perspective view of a portion of the carrier of FIG. 2A.

FIG. 9A shows a perspective view of a portion of the carrier 200. In FIG. 9A, parts of the side 204, the protrusion 205, and the bottom 210 are shown. The bottom surface 205*e* of the protrusion 205 can be welded to the bottom 210 or an adhesive such as a mechanical adhesive can be used to attach the bottom surface 205*e* of the protrusion 205 to the bottom 210. In a similar or identical manner, the bottom surfaces 203*e*, 207*e*, and 209*e*, whose location is shown by FIG. 4A, can be adhered or attached to the bottom 210 to place and/or fix the carrier 200 in the upright state of FIG. 2A.

Figure 9B:
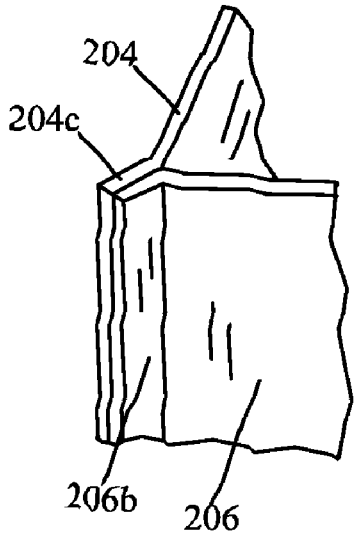
FIG. 9B shows a perspective view of another portion of the carrier of FIG. 2A.

FIG. 9B shows a perspective view of another portion of the carrier 200. FIG. 9B shows part of the sides 204 and 206 and part of protrusions 204*c* and 206*b* The protrusions 204*c* and 206*b* can be welded together or adhered together, such as by an adhesive, such as a mechanical adhesive. In a similar or identical manner, protrusions 204*b* and 202*c*, 202*b*, and 208*c*, and 208*b* and 206*c*, can be welded together or adhered together, such as by an adhesive, such as by a mechanical adhesive to place and/or fix the carrier 200 in the upright state of FIG. 2A.

In at least one embodiment, the carrier 200 may be exactly or substantially rectangular and may have a internal length (not including thicknesses of walls 206 and 202) of L1, which may be about seventeen and three quarters inches, a internal width of W1 (not including thicknesses of walls 204 and 208), which may be about twelve inches, and a internal depth (not including thickness of floor or bottom 210), D1, which may be about ten and one quarter inch as shown by FIG. 2A, when in an upright and assembled state. The dimensions will vary according to manufacturing standards, material shrinkage, and filling operation requirements.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising a device for transporting a plurality of beverage containers comprising:

first, second, third, and fourth sides;

a floor;

wherein the first, second, third, and fourth sides are attached to the floor so that the first second, third and fourth sides can pivot with respect to the floor, and so that each of the first, second, third, and fourth sides can be placed in a first state in which each of the first, second, third, and fourth sides are substantially parallel with respect to the floor and in a second state in which each of the first, second, third, and fourth sides are substantially at a ninety degree angle with respect to the floor;

wherein at least one of the first, second, third, and fourth sides is directly connected to a first bottom protrusion which is at an angle with respect to the at least one of the first, second, third, and fourth sides and which is not connected directly to the floor, so that the first bottom protrusion can not be moved without moving the at least one of the first, second, third, and fourth sides, but can be moved without moving the floor;

wherein in the first state the first bottom protrusion does not directly contact the floor;

wherein in the second state the first bottom protrusion does directly contact the floor;

wherein the at least one of the first, second, third, and fourth sides has a length;

wherein the first bottom protrusion has a length which is substantially parallel to the length of the at least one of the first, second, third, and fourth sides; and wherein the length of the first bottom protrusion is greater than half of the length of the at least one of the first, second, third, and fourth sides.

2. The apparatus of claim 1 wherein the at least one of the first, the second, the third, and the fourth sides is the first side;

the second side is directly connected to a second bottom protrusion, which is at an angle with respect to the second side and which is not connected directly to the floor, so that the second bottom protrusion can not be moved without moving the second side, but can be moved without moving the floor;

the third side is directly connected to a third bottom protrusion, which is at an angle with respect to the third side and which is not connected directly to the floor, so that the third bottom protrusion can not be moved without moving the third side, but can be moved without moving the floor;

the fourth side is directly connected to a fourth bottom protrusion, which is at an angle with respect to the fourth side and which is not connected directly to the floor, so that the fourth bottom protrusion can not be moved without moving the fourth side, but can be moved without moving the floor;

wherein in the first state the first, the second, the third, and the fourth bottom protrusions do not directly contact the floor;

wherein in the second state the first, the second, the third, and the fourth bottom protrusions directly contact the floor;

wherein each of the second, the third, and the fourth sides has a length;

wherein each of the second, the third, and the fourth bottom protrusions has a length which is substantially parallel to the length of the second, the third, and the fourth sides, respectively; and wherein the length of each of the second, the third, and the fourth bottom protrusions is greater than half of the length of the second, third, and fourth sides, respectively.

3. The apparatus of claim 2 wherein wherein the first, the second, the third, and the fourth sides are directly connected to a first left protrusion, a second left protrusion, a third left protrusion, and a fourth left protrusion, respectively, which are at an angle with respect to the first, the second, the third, and the fourth sides, respectively, and which are substantially perpendicular to the first, the second, the third, and the fourth bottom protrusions respectively;

wherein first, the second, the third, and the fourth left protrusions are not connected to any other side of the first, second, third, and fourth sides, other than the first, the second, the third, and the fourth sides, respectively, wherein the first, the second, the third, and the fourth left protrusions are configured so that the first, the second, the third, and the fourth left protrusions can not be moved without moving the first, second, third, and fourth sides, respectively, but can be moved without moving any of the other of the first, second, third, and fourth sides;

wherein in the first state the first, the second, the third, and the fourth left protrusions do not directly contact any of the other of the first, the second, the third, and the fourth sides; and wherein in the second state the first, the second, the third, and the fourth left protrusions directly contact at least one of the other of the first, the second, the third, and the fourth sides;

wherein each of the first, second, third, and fourth sides has a height which is substantially perpendicular to its length; and wherein each of the first, the second, the third, and the fourth left protrusions has a height which is substantially parallel to the height of the first, second, third, and fourth sides, respectively; and wherein the heights of the first, the second, the third, and the fourth left protrusions are greater than half of the height of the first, second, third, and fourth sides, respectively.

4. The apparatus of claim 3 wherein wherein the first, the second, the third, and the fourth sides are directly connected to a first right protrusion, a second right protrusion, a third right protrusion, and a fourth right protrusion, respectively, which are at an angle with respect to the first, the second, the third, and the fourth sides, respectively, which are substantially perpendicular to the first, the second, the third, and the fourth bottom protrusions respectively, and which are opposite the first, the second, the third, and the fourth left protrusions, respectively;

wherein first, the second, the third, and the fourth right protrusions are not connected to any other side of the first, second, third, and fourth sides, other than the first, the second, the third, and the fourth sides, respectively, wherein the first, the second, the third, and the fourth right protrusions are configured so that the first, the second, the third, and the fourth right protrusions can not be moved without moving the first, second, third, and fourth sides, respectively, but can be moved without moving any of the other of the first, second, third, and fourth sides;

wherein in the first state the first, the second, the third, and the fourth right protrusions do not directly contact any of the other of the first, the second, the third, and the fourth sides; and wherein in the second state the first, the second, the third, and the fourth right protrusions directly contact at least one of the other of the first, the second, the third, and the fourth sides;

wherein each of the first, second, third, and fourth sides has a height which is substantially perpendicular to its length; and wherein each of the first, the second, the third, and the fourth right protrusions has a height which is substantially parallel to the height of the first, second, third, and fourth sides, respectively; and wherein the heights of the first, the second, the third, and the fourth right protrusions are greater than half of the height of the first, second, third, and fourth sides, respectively.

5. The apparatus of claim 1 wherein wherein the at least one of the first, the second, the third, and the fourth sides is is directly connected to a first left protrusion, which is at an angle with respect to the at least one of the first, the second, the third, and the fourth sides, and which is substantially perpendicular to the first bottom protrusion;

wherein first left protrusion is not connected to any other side of the first, second, third, and fourth sides, other than the at least one of the first, the second, the third, and the fourth sides;

wherein the first left protrusion is configured so that the first left protrusion can not be moved without moving the at least one of the first, second, third, and fourth sides, but can be moved without moving any of the other of the first, second, third, and fourth sides;

wherein in the first state the first left protrusion does not directly contact any of the other of the first, the second, the third, and the fourth sides; and wherein in the second state the first left protrusion does directly contact at least one of the other of the first, the second, the third, and the fourth sides;

wherein the at least one of the first, second, third, and fourth sides has a height which is substantially perpendicular to its length; and wherein the first left protrusion has a height which is substantially parallel to the height of the at least one of the first, second, third, and fourth sides; and wherein the height of the first left protrusion is greater than half of the height of the at least one of the first, second, third, and fourth sides.

6. The apparatus of claim 5 wherein wherein the at least one of the first, the second, the third, and the fourth sides is is directly connected to a first right protrusion, which is at an angle with respect to the at least one of the first, the second, the third, and the fourth sides, which is substantially perpendicular to the first bottom protrusion, and which is opposite of the first left protrusion;

wherein first right protrusion is not connected to any other side of the first, second, third, and fourth sides, other than the at least one of the first, the second, the third, and the fourth sides;

wherein the first right protrusion is configured so that the first right protrusion can not be moved without moving the at least one of the first, second, third, and fourth sides, but can be moved without moving any of the other of the first, second, third, and fourth sides;

wherein in the first state the first right protrusion does not directly contact any of the other of the first, the second, the third, and the fourth sides; and wherein in the second state the first right protrusion does directly contact at least one of the other of the first, the second, the third, and the fourth sides;

wherein the at least one of the first, second, third, and fourth sides has a height which is substantially perpendicular to its length; and wherein the first right protrusion has a height which is substantially parallel to the height of the at least one of the first, second, third, and fourth sides; and wherein the height of the first right protrusion is greater than half of the height of the at least one of the first, second, third, and fourth sides.

7. The apparatus of claim 1 further comprising a predetermined number of beverage containers, wherein each of the predetermined number of beverage containers is substantially the same as each of the other of the predetermined number of beverage containers;

wherein in the second state, the first, the second, the third, and the fourth sides, and the floor form an inner chamber;

wherein the device is configured so that in the second state the predetermined number of beverage containers oriented upright, fit snugly in the inner chamber, so that the predetermined number of beverage containers take up substantially the entire inner chamber;

wherein each of the predetermined number of beverage containers has a height;

wherein each of the first, the second, the third, and the fourth sides has a height; and wherein the height of each of the first, the second, the third, and the fourth sides is greater than the height of each of the predetermined number of beverage containers.

8. The apparatus of claim 1 wherein the first, the second, the third, and the fourth sides are connected to the floor along first, second, third, and fourth line segments;

wherein a first handle opening is located in a first handle opening side of the first, the second, the third, and the fourth sides;

wherein a second handle opening is located in a second handle opening side of the first, the second, the third, and the fourth sides;

wherein the first handle opening side is opposite the second handle opening side;

wherein the first handle opening has a length and a width, wherein the length of the first handle opening is substantially greater than the width of the first handle opening so that the first handle opening is elongated;

wherein the second handle opening has a length and a width, wherein the length of the second handle opening is substantially greater than the width of the second handle opening so that the second handle opening is elongated; and wherein the length of the first and the second handle openings are both parallel to the same two of the first, the second, the third, and the fourth line segments.

9. An apparatus comprising a device for transporting a plurality of beverage containers comprising:

first, second, third, and fourth sides;

a floor;

wherein the first, second, third, and fourth sides are attached to the floor so that the first second, third and fourth sides can pivot with respect to the floor, and so that each of the first, second, third, and fourth sides can be placed in a first state in which each of the first, second, third, and fourth sides are substantially parallel with respect to the floor and in a second state in which each of the first, second, third, and fourth sides are substantially at a ninety degree angle with respect to the floor; and the apparatus further comprising a predetermined number of beverage containers, wherein each of the predetermined number of beverage containers is substantially the same as each of the other of the predetermined number of beverage containers;

wherein in the second state, the first, the second, the third, and the fourth sides, and the floor form an inner chamber;

wherein the device is configured so that in the second state the predetermined number of beverage containers oriented upright, fit snugly in the inner chamber, so that the predetermined number of beverage containers take up substantially the entire inner chamber;

wherein each of the predetermined number of beverage containers has a height;

wherein each of the first, the second, the third, and the fourth sides has a height; and wherein the height of each of the first, the second, the third, and the fourth sides is greater than the height of each of the predetermined number of beverage containers.

10. The apparatus of claim 9 wherein at least one of the first, second, third, and fourth sides is directly connected to a first bottom protrusion which is at an angle with respect to the at least one of the first, second, third, and fourth sides and which is not connected directly to the floor, so that the first bottom protrusion can not be moved without moving the at least one of the first, second, third, and fourth sides, but can be moved without moving the floor;

wherein in the first state the first bottom protrusion does not directly contact the floor; and wherein in the second state the first bottom protrusion does directly contact the floor.

11. The apparatus of claim 10 wherein at least one of the first, the second, the third, and the fourth sides is directly connected to a first left protrusion, which is at an angle with respect to the at least one of the first, the second, the third, and the fourth sides; and which is substantially perpendicular to the first bottom protrusion;

wherein the first left protrusion is not connected to any other side of the first, second, third, and fourth sides, other than the at least one of the first, the second, the third, and the fourth sides;

wherein the first left protrusion is configured so that the first left protrusion can not be moved without moving the at least one of the first, second, third, and fourth sides, but can be moved without moving any of the other of the first, second, third, and fourth sides;

wherein in the first state the first left protrusion does not directly contact any of the other of the first, the second, the third, and the fourth sides;

wherein in the second state the first left protrusion does directly contact at least one of the other of the first, the second, the third, and the fourth sides;

the least one of the first, the second, the third, and the fourth sides is directly connected to a first right protrusion, which is at an angle with respect to the at least one of the first, the second, the third, and the fourth sides, which is opposite and substantially parallel to the first left protrusion, and which is substantially perpendicular to the floor;

wherein the first right protrusion is not connected to any other side of the first, second, third, and fourth sides, other than the at least one of the first, the second, the third, and the fourth sides;

wherein the first right protrusion is configured so that the first right protrusion cannot be moved without moving the at least one of the first, second, third, and fourth sides, but can be moved without moving any of the other of the first, second, third, and fourth sides;

wherein in the first state the first right protrusion does not directly contact any of the other of the first, the second, the third, and the fourth sides; and wherein in the second state the first right protrusion does directly contact at least one of the other of the first, the second, the third, and the fourth sides.

12. The apparatus of claim 9 wherein at least one of the first, the second, the third, and the fourth sides is directly connected to a first left protrusion, which is at an angle with respect to the at least one of the first, the second, the third, and the fourth sides; and which is substantially perpendicular to the floor;

wherein the first left protrusion is not connected to any other side of the first, second, third, and fourth sides, other than the at least one of the first, the second, the third, and the fourth sides;

wherein the first left protrusion is configured so that the first left protrusion can not be moved without moving the at least one of the first, second, third, and fourth sides, but can be moved without moving any of the other of the first, second, third, and fourth sides;

wherein in the first state the first left protrusion does not directly contact any of the other of the first, the second, the third, and the fourth sides; and wherein in the second state the first left protrusion does directly contact at least one of the other of the first, the second, the third, and the fourth sides.

13. The apparatus of claim 12 wherein the least one of the first, the second, the third, and the fourth sides is directly connected to a first right protrusion, which is at an angle with respect to the at least one of the first, the second, the third, and the fourth sides, which is opposite and substantially parallel to the first left protrusion, and which is substantially perpendicular to the floor;

wherein the first right protrusion is not connected to any other side of the first, second, third, and fourth sides, other than the at least one of the first, the second, the third, and the fourth sides;

wherein the first right protrusion is configured so that the first right protrusion cannot be moved without moving the at least one of the first, second, third, and fourth sides, but can be moved without moving any of the other of the first, second, third, and fourth sides;

wherein in the first state the first right protrusion does not directly contact any of the other of the first, the second, the third, and the fourth sides; and wherein in the second state the first right protrusion does directly contact at least one of the other of the first, the second, the third, and the fourth sides.

* * * * *